United States Patent [19]

Ott: Edward L. et al.

[11] Patent Number: 5,052,615

[45] Date of Patent: Oct. 1, 1991

[54] FOOD CARTON AND METHOD

[75] Inventors: Ott: Edward L., Smyrna, Ga.; Paul F. Petriekis, Palos Park; Michael E. Janis, Naperville, both of Ill.

[73] Assignee: Restaurant Technology, Inc., Oak Brook, Ill.

[21] Appl. No.: 357,379

[22] Filed: May 25, 1989

[51] Int. Cl.[5] ..... B65D 5/20

[52] U.S. Cl. ..... 229/182; 229/23 BT; 229/125.19; 229/178; 229/918; 229/DIG. 4; 229/DIG. 11

[58] Field of Search ..... 229/23 BT, 125.19, 169, 229/174, 191, 915, 918, DIG. 11, 178, 182, DIG. 4

[56] References Cited

U.S. PATENT DOCUMENTS

| | | | |
|---|---|---|---|
| 2,568,204 | 9/1951 | Reeser | 229/918 |
| 2,634,046 | 4/1953 | Weber | 229/182 |
| 2,868,430 | 1/1959 | Hamilton | 229/915 |
| 2,965,279 | 12/1960 | Campbell | 229/915 |
| 2,986,320 | 5/1961 | Nicholls et al. | 229/191 |
| 3,091,381 | 5/1963 | Conescu | 229/182 |
| 3,118,591 | 1/1964 | Allard | 229/169 |
| 3,375,967 | 4/1968 | Robinson | 29/178 |
| 3,749,299 | 7/1973 | Ingle | 229/178 |
| 3,871,570 | 3/1975 | Garmon | 229/915 |
| 4,082,215 | 4/1978 | Eichenauer | 229/178 |
| 4,244,508 | 1/1981 | Schulman | 229/182 |
| 4,266,714 | 5/1981 | Crane | 229/178 |
| 4,369,914 | 1/1983 | Cangstone, Jr. et al. | 229/182 |
| 4,385,721 | 5/1983 | Olsen et al. | 229/915 |
| 4,860,948 | 8/1989 | Hofstede | 229/DIG. 11 |

FOREIGN PATENT DOCUMENTS

| | | | |
|---|---|---|---|
| 1097351 | 1/1961 | Fed. Rep. of Germany | 229/918 |
| 2279638 | 2/1976 | France | 229/918 |
| 2447863 | 10/1980 | France | 229/DIG. 11 |
| 2481230 | 10/1981 | France | 229/915 |

*Primary Examiner*—Gary E. Elkins
*Attorney, Agent, or Firm*—Jenner & Block

[57] ABSTRACT

A carton for a single layer of tomatoes or the like is formed of single thickness corrugated fiberboard which is doubled over at fold lines along opposing walls is provided. The fold lines lie in differing planes so that each of two opposing walls have relatively long recesses at the upper portions thereof with a doubled thickness of fiberboard below such recesses. The other opposing walls include a double thickness along substantially the entire length of the wall. Corner members extend across the top corners of the carton to strengthen the carton as well as to facilitate stacking of cartons. Optional upstanding tabs facilitate stacking. The recesses promote airflow over tomatoes or the like held in the carton.

9 Claims, 10 Drawing Sheets

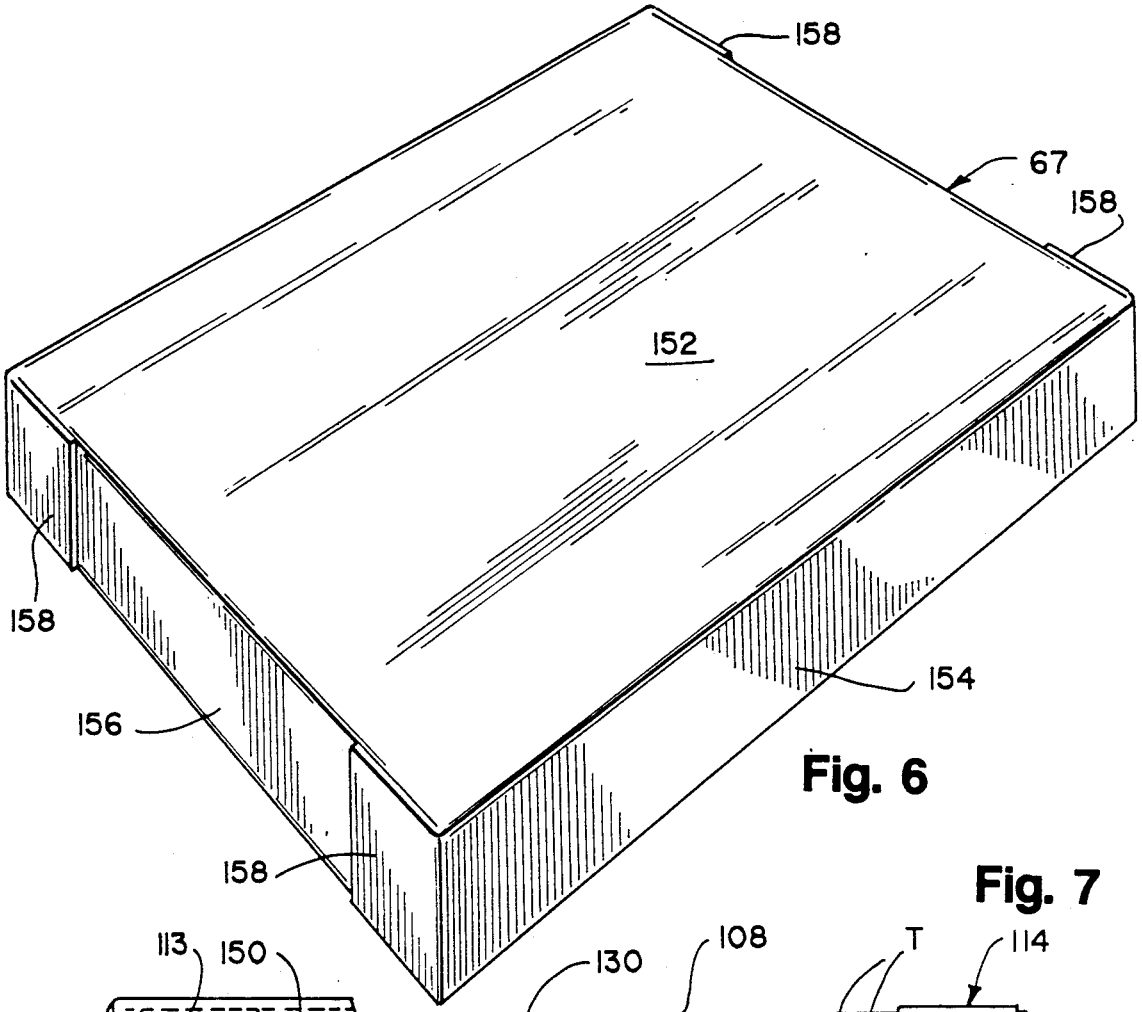
Fig. 6
Fig. 7
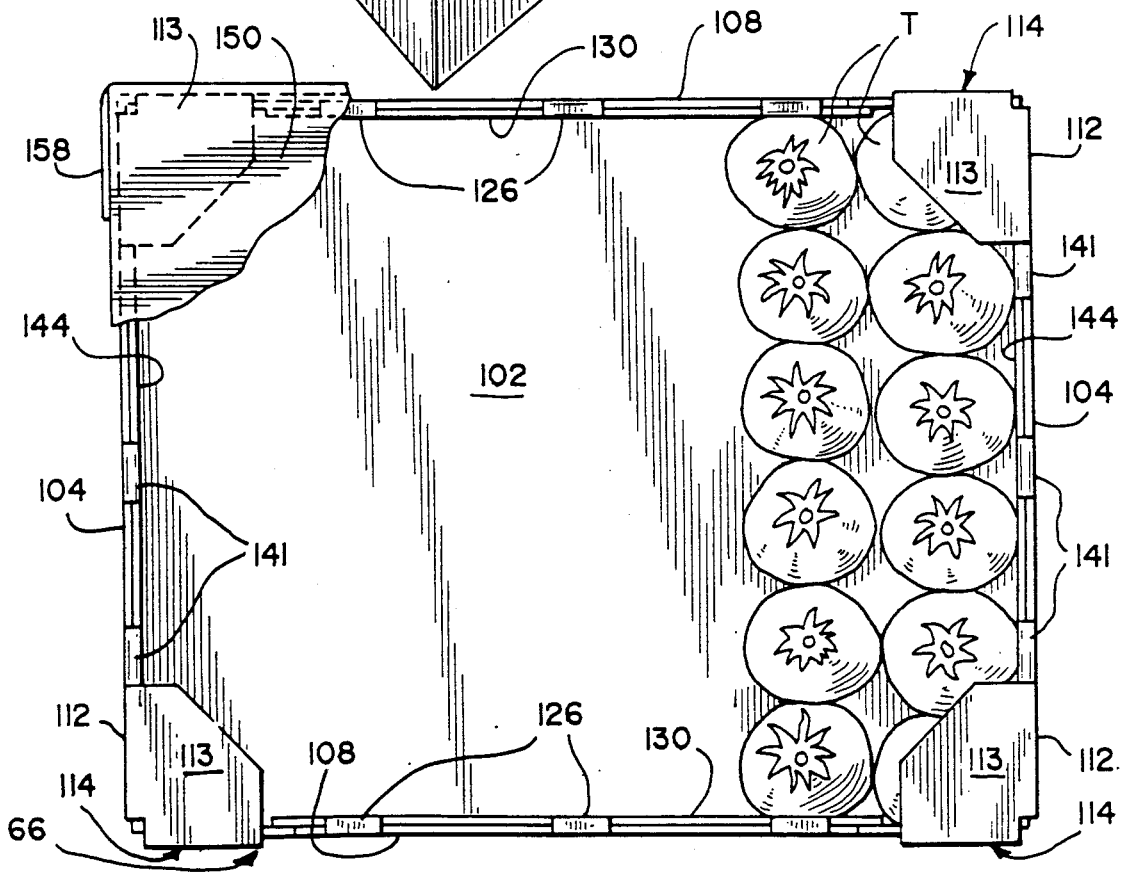

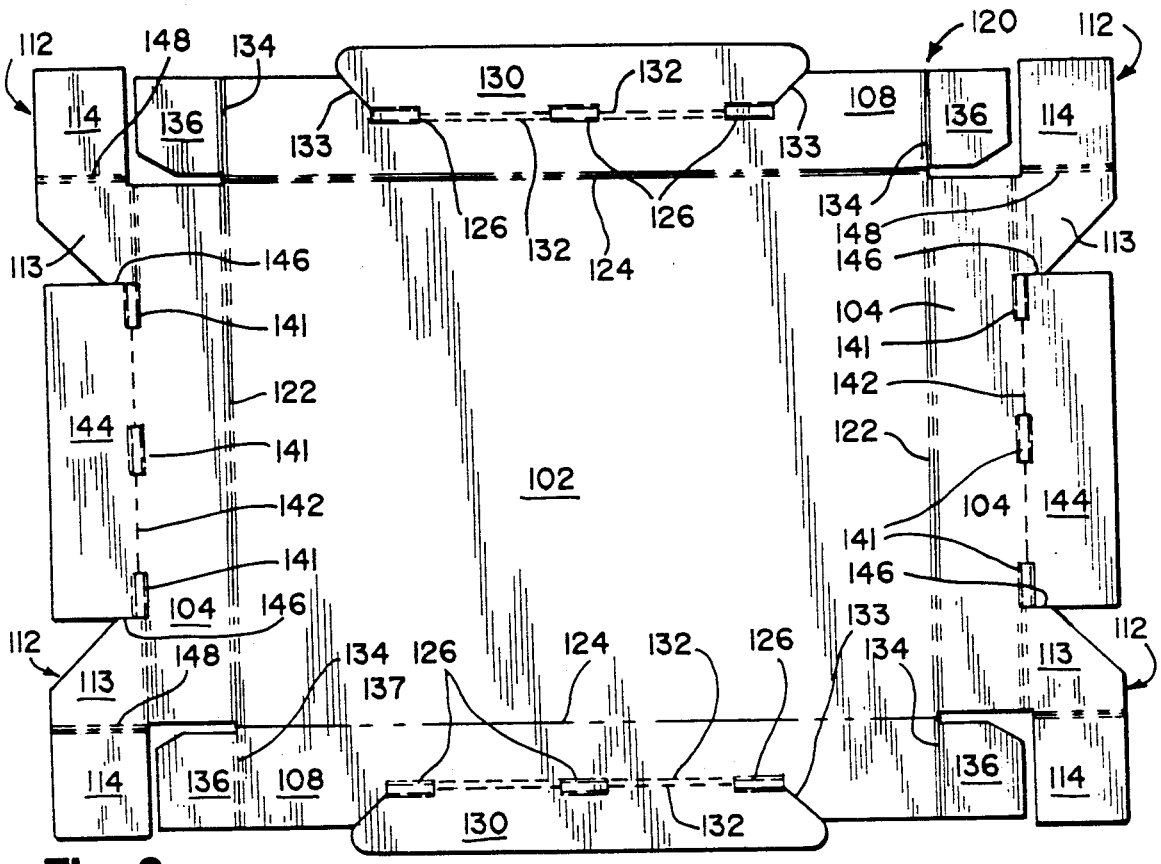
Fig. 8
Fig. 9
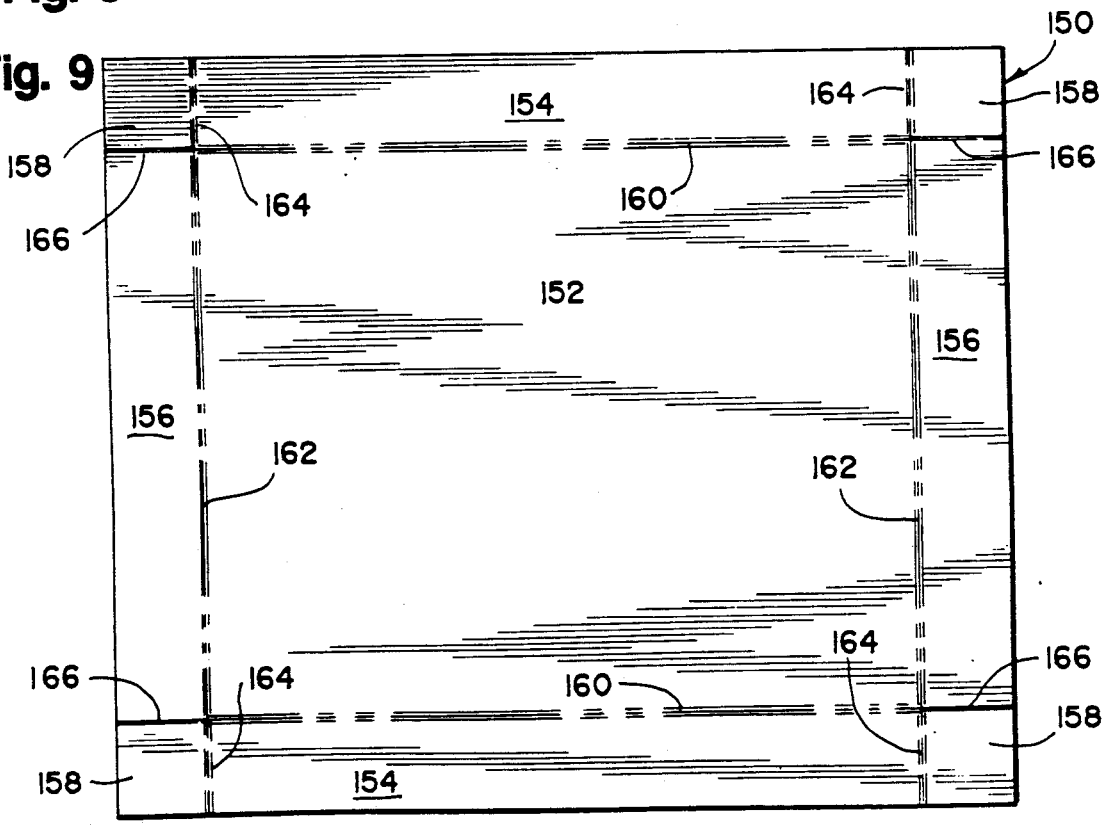

FOOD CARTON AND METHOD

FIELD OF THE INVENTION

The present invention relates to boxes for packaging tomatoes or other objects, especially objects which are not geometrically similar or spherical (such as most fruits), as well as spherical products, whether natural or manufactured. The present invention also relates to a system and method of handling and artificially ripening vegetables and fruits. The vegetables and fruits which may particularly be ripened by this system and method are those which give off ethylene gas during their natural ripening. Illustratively and as an example, the use of tomatoes in the present invention is described.

BACKGROUND OF THE INVENTION

When tomatoes are harvested and sorted, they are normally packaged in standard 25 pound bulk pack boxes. Each such box normally holds between 72 and 84 tomatoes, without using dividers. Growers ship the produce to a professional tomato repacker who checks the tomatoes for quality, sorting them by size and color. The tomatoes are then repacked into standard 25 pound bulk boxes and shipped to grocery stores, restaurants, and other retailers and users.

Packing tomatoes in the standard 25 pound bulk box, which ordinarily has a dimension in the range of 8 inches depth by 12 inches width by 18.5 inches length, permits individual tomatoes during ripening, packing, or transit to be damaged relatively easily. The standard 25 pound bulk box allows pressure to develop on individual tomatoes and encourages spoilage and concussion bruising. Also, cross-contamination may occur. One rotten tomato can ruin its neighboring tomatoes, particularly the tomatoes below the rotten tomato. When the bulk shipment is received at its final destination, such as a restaurant, the tomatoes can be sorted, and waste or spoiled tomatoes can be discarded. If the rotten tomatoes are not promptly sorted at the delivery destination or restaurant from the good tomatoes, further tomato spoilage and bruising occurs during the storage period before use.

Although this known standard 25-pound bulk pack box as described above has attained widespread use for shipping tomatoes from the field to the store or restaurant, its use has a number of disadvantages. The harvested tomatoes are typically sorted several times by color, size and condition (e.g., to remove spoiled tomatoes) prior to the time of intended use or prior to delivery of a final destination, such as a restaurant, for example. A new box and handling method is so that the effects of spoilage during shipping and storage, and the need for repacking and sorting between harvesting and use are minimized or eliminated.

When tomatoes are harvested, sorted and packed in standard 25 pound bulk pack boxes, the tomatoes are typically not in a ripened state for several reasons. First, there is less of a likelihood of damage occurring during harvesting when the tomatoes are firm and not ripe. The tomatoes are harvested before ripeness since unripe tomatoes are better able to withstand the rigors of harvesting, packing and shipment. Second, there is typically a period of time between harvesting and consumption of the tomatoes. If tomatoes are ripe when harvested, there is a greater likelihood of spoilage before reaching the consumer since the tomatoes will continue to naturally ripen further after harvesting.

Since the tomatoes are typically not ripe when harvested, it is frequently desirable to artificially ripen the tomatoes at least to some degree and at some point between harvesting but before being shipped to the store or restaurant. Typically, a tomato that is harvested ripe is termed "vine ripe" and a tomato harvested green to be artificially ripened is termed "gas green." One method known to the art of artificially ripening tomatoes is by placing the tomatoes into a substantially sealed room or container and introducing ethylene gas into the room in a predetermined concentration, humidity and temperature. The ethylene may be introduced into the room either alone or as part of a gaseous mixture. The ethylene is introduced in a concentration sufficient to effectuate the desired degree of ripening of the tomatoes. Generally, the degree of ripening achieved can be controlled by controlling the concentration of ethylene introduced and the amount of time that the tomatoes are exposed to the ethylene. The tomato grower is typically the entity that undertakes this ripening process, although a repacker may also undertake this process.

All kinds of vegetables and fruits are typically susceptible to this method of artificial ripening, especially vegetables and fruits which themselves give off ethylene during their natural ripening. The ethylene added to the room serves to reduce the time of ripening required as compared to natural ripening.

Typically, the 25 pound bulk pack boxes containing the tomatoes are placed after harvesting directly into the gas-sealed enclosure, such as a tractor trailer or a room, illustratively, and the same boxes are removed from the gas-sealed room after the desired degree of artificial ripening has been achieved. Although the amount of time that the tomatoes are left in the room depends on the ripeness (maturity) of the tomatoes placed in the room and the degree of ripening desired, the time that the tomatoes spent in the sealed room is typically between seven to nine days.

Further, the tomatoes must typically be sorted after removal from the room since tomatoes enter the room at different stages of ripeness and maturity. Specifically, as these tomatoes ripen in the 25 pound boxes, the tomatoes ripen at different rates depending on their entering ripeness and location in the box. As a result, the tomatoes exit the ripening room at different stages of ripeness. The tomatoes must then be sorted again to segregate tomatoes of the same degree of ripeness. Color sorting of tomatoes is typically used to sort these tomatoes.

This known method of artificial ripening as described above is time and very labor intensive. A new system and method of artificial ripening using ethylene is needed so that the tomatoes spend less time in the sealed room and to reduce sorting than under known methods. Reducing the artificial ripening time reduces processing time and cost. Further, a system and method of artificial ripening is desired in which the tomatoes enter the room at different degrees of ripeness but exit the room at substantially the same ripeness, or at least within a closer range of degrees of ripeness. Processing time and cost is thereby reduced since less or no sorting is needed after the artificial ripening. A method and system whereby the natural ripening process is enhanced and controlled is most desirable so that the need for an artificial ripening process involving a sealed room and the introduction of ethylene gas is reduced in time.

In summary, a need therefore exists to handle and package tomatoes in a manner that is less likely to cause damage in transit and so that spoilage of on tomato, either during transit or thereafter, is less apt to spoil other tomatoes also in the box.

A need also exists to provide a method and controlled system using ethylene for artificially ripening tomatoes which requires a reduced exposure time of the tomatoes to the ethylene.

A need also exists to provide a method and system which enhances and expedites the natural ripening of the tomatoes.

A need also exists to provide a method and system in which there is more uniform ripening of the tomatoes, whereby there is less of a need to sort the tomatoes after the artificial ripening process.

In accordance with the present invention, it has been discovered that the limitations of the standard 25 pound tomato box are surpassed by a new type of tomato carton and method of packing and ripening tomatoes.

SUMMARY OF THE INVENTION

In accordance with the invention, a carton is provided in which tomatoes, or other produce, are packed in single layers rather than in random orientation in a standard 25 pound bulk box. The packing by growers or repackers of the tomatoes in single layers provides several advantages. For example, the effects of spoilage from one tomato during shipping and storage is minimized. Specifically, when a spoiled tomato rests on other tomatoes, as in a box of randomly oriented tomatoes, cross-contamination occurs. One rotten tomato can ruin its neighboring tomatoes, particularly the tomatoes below the rotten tomato. When packed in a single layer, there are no tomatoes below or above the rotten tomato, and spoilage effects are minimized. Further, it has been discovered that the effects of cross-contamination of adjoining tomatoes is also reduced when packed in single layer cartons. There is less concussion bruising of the tomatoes in a single layer since the tomatoes are not piled on top of each other, and there is typically more clearance between the tomatoes in a single layer than in random orientation in a bulk box. Concussion bruising also tends to knock the fruit seeds and gel out of place and when sliced, the seeds and gel tend to ooze out rather than remain within the tomato. Consequently, there is a significant improvement in the yield not only of total number of tomatoes but a significant improvement in the yield per tomato since the tomatoes are more "gently" handled in the single layer boxes. Less spoilage occurs and quality control is increased thereby packing the tomatoes into single layer cartons.

Another advantage is that the need for repacking and color sorting is reduced. Specifically, when harvested, the tomatoes may then be color sorted so that no color sorting, repacking and shipping needs to be done by a middleman, (i.e., a professional repacker) because the repacker's tasks are done by the harvesting crew in or near the fields. The tomatoes are color sorted in the field or harvested at the same maturity so that the container can be shipped directly to the retailer or user, or handled together as a unit without having to be unloaded and loaded from one box to another. The elimination of a middleman can significantly reduce the cost of handling after harvest. Further, when originally sorted, any defective tomatoes may be detected and removed before entering the transport and distribution chain. Although government standards allow for approximately 15% defective tomatoes in each shipment, removal of these defective tomatoes by the grower can significantly reduce the number of defective tomatoes.

Also, a more consistent number of tomatoes can be shipped since a (fairly) uniform number of tomatoes can be packed into each single layer carton with no layer to layer variable nesting of tomatoes. Packing in single layers and by count rather than by poundage provides this advantage. For example, 72 to 84 tomatoes are typically packed into a standard 25 pound box. Depending on the size of the single layer carton, approximately 65 tomatoes will be contained in each single layer carton which is about 21 pounds of tomatoes. The single layer carton with its lid attached generally should not be air tight, so that ripening can be augmented as hereinafter described.

The end user, such as a restaurant or store, also receives benefits from the present invention. For example, each tomato in a single layer box can be stored for approximately the same time before use since all of the tomatoes in a particular single layer box will have approximately the same ripeness. Further, immediate handling of the tomatoes upon delivery of the box to the user is facilitated. The entire contents of the carton can be quickly visually inspected, and any spoiled tomatoes within the single layer are localized, contained and can be easily removed. In contrast, when packed in bulk boxes, the entire content would have to be emptied and repacked by store or restaurant costing additional time and labor. Also, the single layer boxes provide a smaller and more manageable unit for handling. Further, shelf life of the tomatoes has been significantly increased. The normal shelf life of the tomatoes in the 25 pound bulk boxes is about 10 days. By packing the tomatoes in single layer boxes, the shelf life is doubled, sometimes tripled or more. Shelf life of over one month has been achieved by the present invention.

In accordance with one embodiment of the invention, a container is provided having a generally rectangular floor, first walls and second walls extending from the floor, a recess on each of the first walls and corner portions located at the intersections of the first and second walls. Each corner portion has a planar portion extending parallel to the floor, but separated from the floor by a distance substantially equal to the height of the first and second walls. Each of the corner portions also has a planar portion and a flap extending therefrom, the flap extending downward from the corner portion, and the flap being folded over a corresponding first wall or second wall and adhered thereto. Each of the planar portions extends from a first fold line of either the first or second walls and each flap is adhered to the other of the first or second walls. Further the recess extends about substantially the entire distance between the corner portions. The carton can be formed from corrugated fiberboard.

The recess in each of the first or side walls is defined by a fold line along the first wall and laterally spaced score lines extending from the fold line to the outer edge of the first wall to define a flap, said flap being folded at the fold line to provide a double thickness of material between the recess and the floor. These score lines are non-orthogonal with respect to the fold lines. The flap can be glued to the first wall. Alternatively, the flap includes a flap tab with aperture formed in the floor at the periphery of the flap, with the flap tab engaging the aperture.

Each second or end wall can have an upstanding tab, with the upstanding tabs opposing each other. The second wall can include a doubled thickness of material having a fold line at the top of the container.

In accordance with another aspect of the invention, each of the first and second walls has a fold line about which corrugated fiberboard is folded 180 degrees to form a double thickness of fiberboard, the fold lines in the first walls lying in a first plane, and the fold lines of the second walls lying in a second plane, with the first plane and the second plane being different and both being elevated off of the floor.

In accordance with another aspect of the invention, a carton formed of corrugated fiberboard is provided from a single carton blank having four inner fold lines. First outer fold lines are located at a first distance from a corresponding inner fold line, each defining a flap which provides a double thickness of fiberboard when the flap is folded over its first outer fold lines. In addition, at least one rectangular hole facilitating the folding of the flap along the outer fold line is provided. The rectangular hole which has four side edges intersects the outer fold line at only one point along the outer fold line. Second outer fold lines are parallel to a corresponding inner fold line and separated therefrom by a second distance which is less than the first distance, with score lines extending from second fold lines to the outer periphery of the blank. The score lines and the second fold lines define a long flap. The blank is punched to define corner tab pieces and corner portions. The first distance can be substantially one-half the distance between the first inner fold line and a corresponding outer edge of the blank or outer edge of a flap.

In accordance with another aspect of the invention, a cold-bonding adhesive and a hot melt adhesive are utilized in order to secure the flaps to an adjacent portion of the walls after the flaps are folded over the outer fold lines. A system and method is provided for artificially ripening tomatoes in which the tomatoes are packed into a single layer in a carton. The cartons may be stacked one on top of each other, with the tomatoes being placed in a gas-sealed area, such as a room or truck trailer, for example, and then exposed to ethylene gas in a concentration and for a time and humidity sufficient to enhance ripening. Further, one or more such cartons may be wrapped in plastic, thereby enhancing the natural ripening of the tomatoes by allowing at least some of the ethylene naturally given off by the tomatoes to remain in the carton, as well as added ethylene.

The system and method of artificially ripening tomatoes in which the tomatoes are packed into single layer cartons has several advantages. The time of exposure of the tomatoes to the introduced ethylene is reduced. Also, there is a ripening of the tomatoes such that although the tomatoes enter the ripening area at varying degrees of ripeness or maturity, the tomatoes exit the room within a closer and more uniform range of ripeness. This reduces and can eliminate the need to sort the tomatoes after the artificial ripening process.

In accordance with another embodiment of the invention, a system for artificially ripening produce which give off ethylene during natural ripening is provided. The system includes a substantially gas-impermeable sealed room or carton, a source for providing ethylene gas into the room or carton at a concentration sufficient to enhance ripening of the produce, and a carton into which the produce can be packed in a certain single layer. The produce used can be, for example, tomatoes. The carton is made of corrugated cardboard of sufficient strength to withstand exposure to the ethylene gas, temperature, humidity and time.

In accordance with another embodiment of the invention, a method for artificially ripening produce which gives off ethylene during natural ripening is provided. The method includes packing the produce in a single layer in a container, placing the container loaded with the produce in a substantially gas-impermeable sealed room, and adding ethylene to the room at a concentration, humidity and for a time sufficient to accelerate ripening of the produce to a desired ripening or in accordance to utilize the single layer carton as a gas room itself.

In accordance with one aspect of the invention, the carton which may be used in the method can be approximately 20 inches wide, 24 inches long and 3½ inches deep. A cover is placed on the container after the tomatoes are packed in the container, and at least two of the loaded containers can be stacked in a vertical stack. The vertical stack can be wrapped in plastic, and the vertical stacks can be placed side by side.

In accordance with another embodiment of the invention, a method of packaging, ripening and shipping of produce is provided. The method includes: (1) packing the produce in a single layer in a carton; (2) transporting the carton loaded with the produce into a substantially gas-sealed enclosure; (3) adding ethylene to the enclosure or carton at a concentration, humidity and for a time sufficient to accelerate ripening of the produce to a desired ripeness; (4) removing the carton loaded with the produce from the substantially gas-sealed enclosure; and (5) transporting the carton loaded with the produce to the ultimate user of the tomatoes or storing the tomatoes in the carton until shortly before, or until, the time of intended use. Steps 2–4 can be eliminated and thus are optional. Intended use for a grocery store can be placing the produce at the point of sale, for example, and for a restaurant, storing until the produce is needed, for example, such as the incorporation into another food item or other use. The method can further include the step of sorting at least some of the produce by degree of ripeness and removing at least some of the defective produce. The gas-sealed enclosure can be a tractor trailer, room or carton, for example.

Other objects and advantages of the invention will become apparent upon the following detailed description with reference to the drawings. Throughout the drawings, like reference numerals refer to like parts.

This application is related to the application filed simultaneously herewith by A. P. Zavodsky, C. D. Deshich, and E. L. Ott entitled "Tomato Packing Machine," Ser. No. 07/357,378, Attorney Docket No. 25570-38008), the disclosure of which is incorporated by this reference.

BRIEF DESCRIPTION OF THE DRAWINGS

FIG. 6 is a perspective view of a carton according to the present invention that has been fitted with a lid;

FIG. 7 is a plan view of the carton in FIG. 6 as partially loaded and with a portion of the lid in section FIG. 8 is a plan view of an unassembled blank of the carton in FIG. 6;

FIG. 9 is a plan view of an unassembled blank of the lid in FIG. 6;

DESCRIPTION OF THE PREFERRED EMBODIMENT

Figure 1:
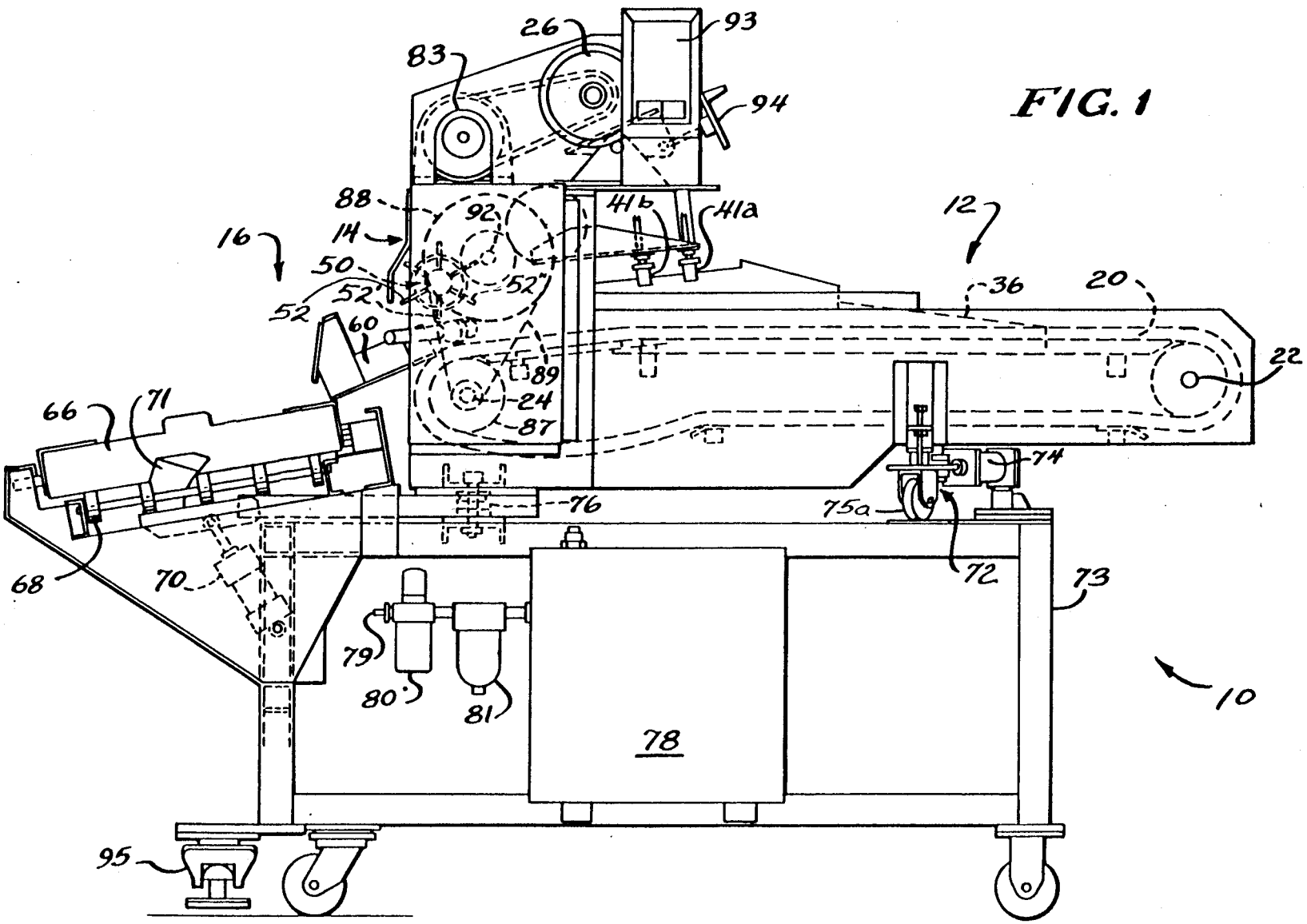
FIG. 1 is a side view of a packing machine used in one application of the invented carton.
Figure 2:
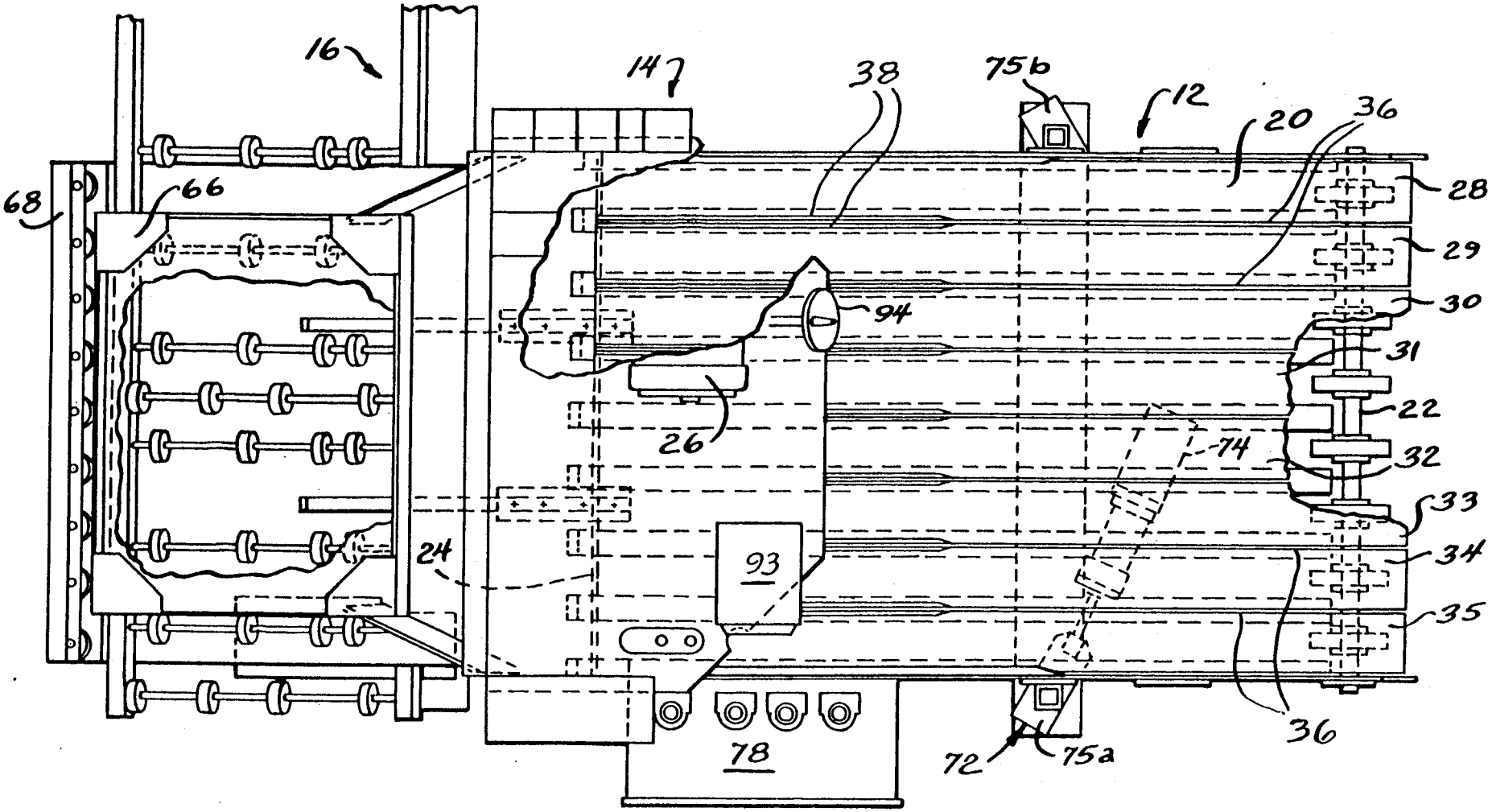
FIG. 2 is a plan view of the machine shown in FIG. 1.

A packing machine 10 according to the present invention is shown in FIGS. 1 to 5. Although reference is now made to employing the machine to pack tomatoes, it could similarly be used to pack such food products as apples, lemons, peaches, potatoes, onions, and other items, or manufactured goods such as tennis balls. Machine 10 includes a rear portion 12, a holding or counting station 14, and a front portion 16. Rear portion 12 of the machine receives bulk tomatoes and arranges them into lanes (see FIGS. 2 and 4), all in a plane generally parallel to ground illustratively. Rear portion 12 may cooperate with any device for loading tomatoes onto rear portion 12. For example, an inclined chute (not illustrated) which in plan view is a triangular section with upstanding curved edges can couple the relatively wide rear portion 12 of packing machine 10 to a relatively narrow conveyor (not illustrated) or the like which may be used to receive bulk tomatoes out of boxes, such as standard 25 pound boxes. The conveyor transports the tomatoes to the chute where they roll down the inclined base of the chute onto rear portion 12 of machine 10.

Rear portion 12 preferably includes a conveying apparatus comprising a low backline pressure chain which is illustratively about three feet wide. This conveyor includes several separate but parallel endless conveyor belts 20, each formed by numerous rollers to reduce friction on the items they transport. Such belts are available commercially from Rexnord, and sometimes called "low back line pressure" or "zero gravity feed" belts. The conveyor belts 20 are rotatably mounted around a tail shaft 22 and a front shaft 24 which is driven by a motor 26 (via gears and sprockets described infra) to transport the tomatoes to a counting station 14. As they travel forward, the tomatoes are grouped into eight separate lanes 28, 29, 30, 31, 32, 33, 34 and 35 by divider walls 36 each extending in a direction parallel to the forward movement of the tomatoes. Divider walls 36 taper in height from zero height above the belts near the rear portion of the conveyor to approximately four inches over the belts at the front-most portion (see FIGS. 1 and 4). This allows the tomatoes to be channeled without injury into eight separate lanes.

Preferably seven lanes, 28 to 34, are always active, and the eighth lane 35 is used as an escrow lane. Each divider wall 36 supports one or a pair of tapered walls 38 which taper the lanes to narrower dimensions closer to holding or counting station 14. One purpose of this tapering of the opening is to prevent two tomatoes from becoming wedged side-by-side in any lane. Also, the taper walls center the tomatoes and help orient them on their sides. Each tapered wall 38 may comprise a one-quarter inch thick UHMW polyethylene strip fastened to each side of a lane.

At counting station 14, a mechanism notes when tomatoes arrive at each of the active lanes. The counting mechanism illustratively includes a respective movable finger 40 (FIG. 4) for each of the seven active lanes, a different mechanism 41 being employed in the escrow lane. Each finger 40 extends from above into the respective lane, but does not fully block passage therethrough by tomatoes. Fingers 40 are coupled to sensors 42 coupled to air logic 44. When a tomato enters an active lane, the corresponding finger 40 is activated by the tomato, which is sensed by the sensor 42. The air logic system determines that tomatoes have arrived in each of the active lanes and therefore are ready to be discharged.

Figure 5:
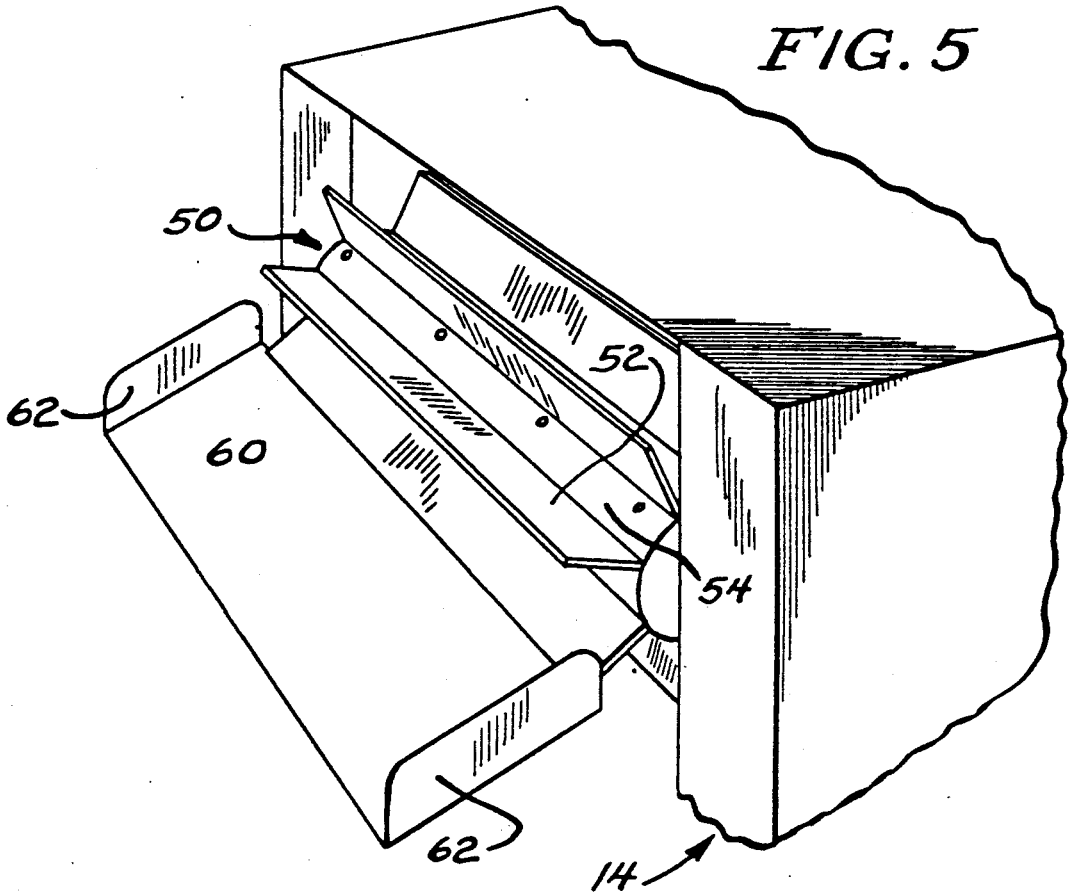
FIG. 5 shows a perspective view of the paddle wheel in the illustrated packing machine.

Also at counting station 14, a horizontally oriented paddle wheel 50 illustrated partially in FIG. 5 has a plurality of, in this case six, radial arms or paddles 52 made of a flexible material such as rubber. Paddles 52 are evenly spaced with respect to each other and extend from a rotatably driven, horizontally oriented cylinder 54 and are dimensioned such that a tomato of the size which is customarily used (such as three inches in diameter or larger) fits into and can be readily transported in the space between each radial arm. Paddle wheel 50 will not rotate until sensors 42 and logic 44 indicate that tomatoes are present in each of the seven active lanes 28 to 34. When the paddle wheel rotates, it transfers the seven tomatoes out of counting station 14 onto a chute 60 where they are guided into a corrugated fiberboard carton 66. Chute 60 may have upstanding side walls 62 to prevent the released tomatoes from falling off the chute.

Mechanism 41 includes air cylinders **41*a* and 41*b* (see FIGS. 1 and 4) positioned at respective locations over or near escrow lane 35. When either cylinder is activated (extended), its arm extends into the escrow lane to prevent passage of tomatoes therepast. When air cylinder 41*a* or 41*b* is retracted, tomatoes can pass by the respective cylinder. The end of the arm is protected by a rubber pad or the like so as not to bruise the tomatoes which enter the escrow lane. Preferably, air cylinder 41*a* is mounted in a slidable track oriented lengthwise with respect to the escrow lane. As such, cylinder 41*a* can be positioned selectively at various locations along escrow lane 35 (generally at the holding station 14). This selective mechanical adjustment of the position of the air cylinder 41*a* will allow adjustment of the number of tomatoes which will be held in escrow lane 35 between air cylinders 41*a* and 41*b*. Air cylinder 41*b* is located at the front of holding station 14**.

Air cylinders **41*a* and 41*b* cooperate to open (retract from lane 35) and close (advance towards lane 35 to block tomato passage) reciprocally to allow a regulated number of escrow tomatoes to pass through holding station 14 during one cycle of operation. In the preferred embodiment, paddle wheel 50 has seven arms, and there are seven active lanes feeding the paddle wheel. One cycle of operation comprises the rotation of nine sections of the paddle wheel. Hence, sixty-three tomatoes are discharged via the paddle wheel in one cycle, and during the cycle air cylinder 41*b* opens and air cylinder 41*a* closes to permit the tomatoes held in escrow also to be discharged onto chute 60**. It will be appreciated that other arrangements for regulating the discharge of escrow tomatoes may be substituted within the scope of the invention.

In accordance with an important aspect of a preferred embodiment of the invention, the tomatoes are fed to paddle wheel 50 by the conveying apparatus that includes lanes 28–35. Thus, in operation, a tomato (not shown) in each of lanes 28–34 (optionally also in escrow lane 35) is delivered against paddle 52' that extends vertically downwardly, as shown in FIG. 1. Paddle wheel 50 then rotates in a clockwise direction as viewed in FIG. 1 to release a single tomato from each of lanes 28–34 (and optionally one from escrow lane 35) and next paddle 52'' on paddle wheel 50 becomes vertically aligned and extends downwardly until paddle wheel 50 is again activated. The portion of lanes 28–34 adjacent paddle wheel 50 can be slightly inclined downwardly (as illustrated in FIG. 1) to promote the roll of tomatoes into chute 60 when paddle wheel 50 is again rotated to release another row of tomatoes. If any of the tomatoes do not roll or slide into chute 60 when released by rotation of paddle wheel 50, the next paddle of paddle wheel 50 may be designated to sweep the tomato or tomatoes into chute 60.

Carton 66 may be held on a conveyor, preferably a roller or skate device 68, able to deliver cartons in succession to the front of machine 10 and, after the cartons are filled, transport them away from the machine. A sensor switch (not shown) on the front conveyor determines that a carton is indeed in place and ready to receive tomatoes. An arm from a cylinder 70 causes a centering mechanism 71 to rise and engage carton 66 so that it can be centered properly with respect to chute 60 as well as with the rear portion of the machine. Preferably skate 68 has a slight transverse incline. That is, preferably the floor 102 of carton 66 is not level but instead is inclined at approximately a six to seven degree or more angle, as shown in FIG. 1, so that tomatoes entering the raised end of the carton will roll naturally toward the lower end of the carton. Because tomatoes tend to roll on their sides rather than their bases, when they come to rest in the carton, many or most of them remain on their sides. This permits more tomatoes to be packed into each carton due to a nesting effect and because of the shape of the tomato. A manual operator has little or no remaining work to do to orient the few tomatoes which do not come to rest on their sides.

It should be noted that the tomatoes roll off the loading chute (not illustrated) onto the machine 10 and continue their natural roll all the way toward holding station 14 until they are stopped by paddles 52 of paddle wheel 50, and the extended arm of air cylinder **41*b*. At that point, the tomatoes will be aligned in eight controlled, spaced lanes and will thereafter be released, by rotation of paddle wheel 50 and withdrawal of the arm of cylinder 41*b*, through front chute 60 into carton 66. Carton 66 preferably will oscillate side-to-side after cylinder 70 elevates mechanism 71 to engage carton 66**. This front end oscillating motion helps to distribute the rolling tomatoes evenly throughout the carton, promotes the nesting effect of the discharged tomatoes into the box, and thereby permits more efficient packing.

As mentioned, machine 10 oscillates at two locations. Rear portion 12 of the machine with its eight lanes oscillates laterally from side-to-side to help minimize the spacing between rolling tomatoes descending from the entry or loading chute so that tomatoes roll or orient into all of the different lanes. Several means can be used to achieve this. In this embodiment, as shown in FIG. 1, a wheel arrangement 72 permits rear portion 12 to roll on a horizontal cross-member of a frame 73. The second oscillation previously mentioned occurs at the front portion 16 of the machine where the tomatoes are loaded into cartons. Wheel arrangement 72, seen advantageously in FIGS. 1 and 2, includes an air cylinder 74 engaging frame 73. The arm of cylinder 74 suitably engages a first wheel **75*a* mounted for rotation in two dimensions by bearings to rear portion 12. A second wheel 75*b* is also mounted similarly to rear portion 12 via bearings so that rear portion 12 may move laterally. Air cylinder 74 is of the reciprocating type which cooperates with limit switches (not illustrated). While air pressure is applied, the arm of air cylinder 74 extends outward, causing rear portion 12 of machine 10 to be driven in a first lateral direction. When the arm reaches a limit switch, the air cylinder 74 operation reverses direction and pulls the rear portion 12 in the opposite lateral direction. This movement continues until a second limit switch (not shown) is reached which again reverses the movement of air cylinder 74 so that rear portion 12** moves in the first lateral direction again. In this manner, the rear of the machine oscillates laterally. Variable speeds can be developed by the machine.

A main pivot 76 (FIG. 1) is mounted preferably beneath holding station 14 and may comprise illustratively a self-aligning spherical bearing with a pivot weldment. This structure permits the rear oscillation to occur, and at the same time causes the front portion 16 to oscillate laterally from side to side in a manner reciprocal to the oscillations of rear portion 12. The lateral oscillations of front portion 16 permit tomatoes discharged from front portion 16 to become more densely packed in carton 66.

Preferably, an air logic system 78 which includes logic 44 governs the release of tomatoes from the active lanes via the paddle wheel because of its enhanced durability and ability to operate successfully for prolonged periods in hostile environments, such as the repacking or field environments. Initial attempts were made to use photoelectric devices to sense the presence of tomatoes in each lane. However, because of the difference in shades among tomatoes as they ripen, photoelectric sensing has not been satisfactory. The present arrangement, using fingers extending from above and coupled to air logic, senses the presence of a tomato in the corresponding lanes. This is reliable and does not damage the tomatoes. To drive air logic system 78, an air inlet 79 is to be coupled to a compressor (not shown). The compressor may exist independent of the present packing machine or can be provided with the machine if none is otherwise available. A filter 80 and pressure regulator 81 are interposed between inlet 79 and logic system 78.

Figure 3:
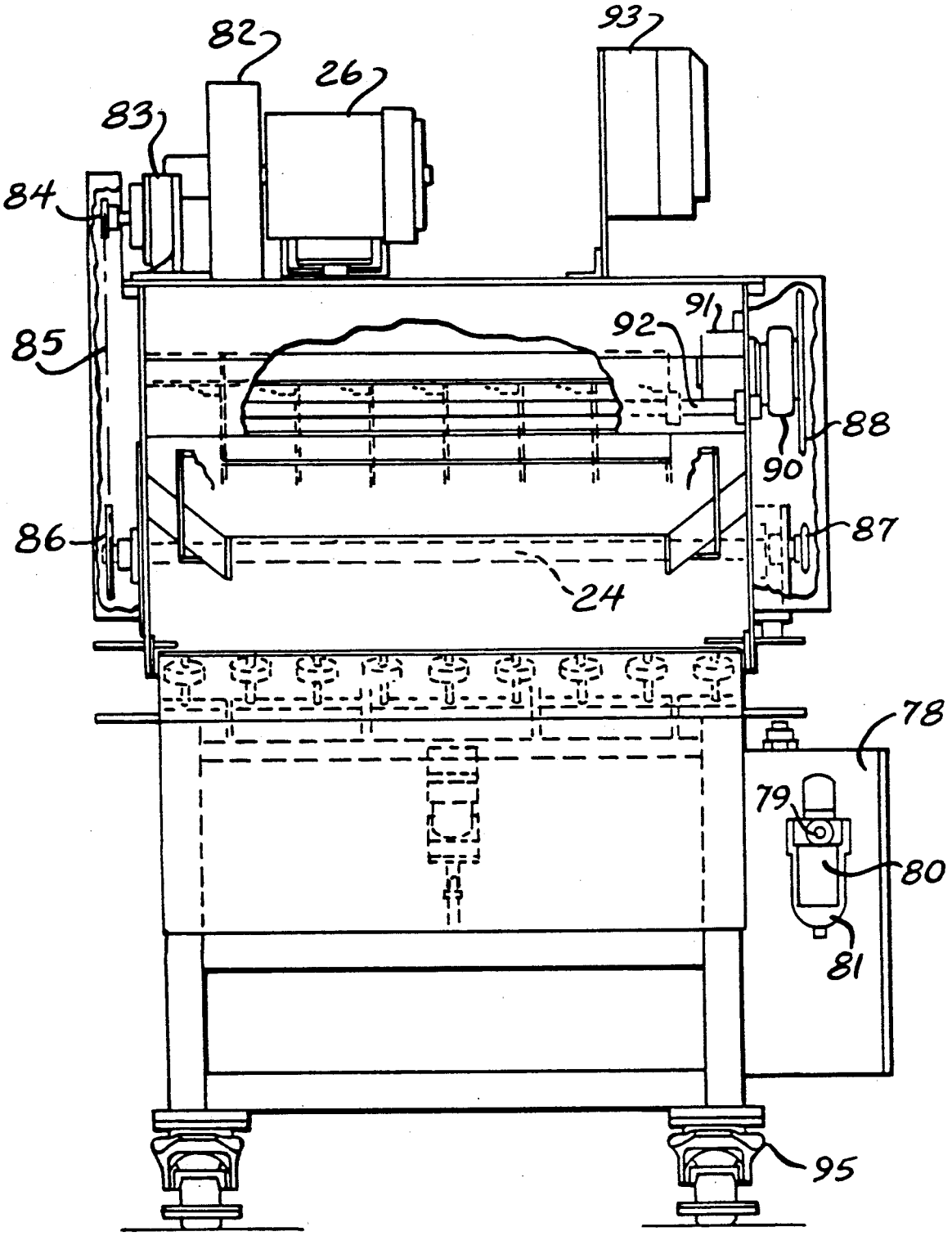
FIG. 3 is a front view with parts broken away of the machine of FIGS. 1 and 2.
Figure 4:
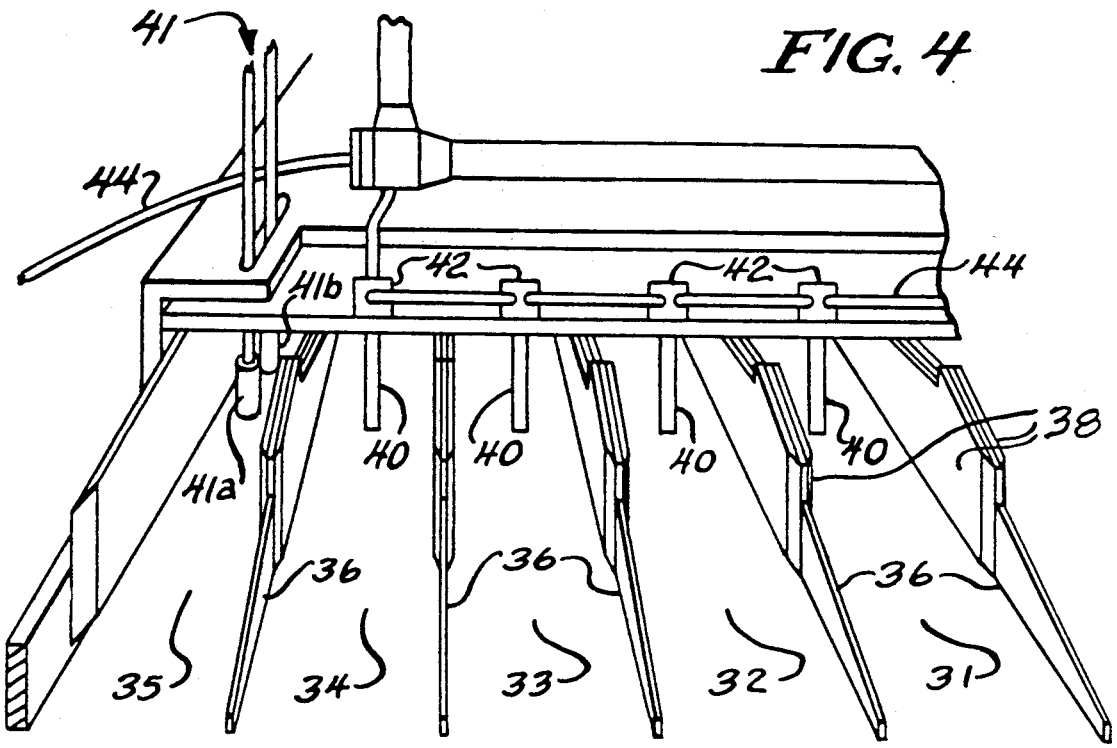
FIG. 4 is a schematic view of part of the machine of FIGS. 1 and 2.

As mentioned, motor 26 drives paddle wheel 50. Motor 26 may illustratively be a one-quarter horsepower electric motor. Referring to FIG. 3, motor 26 is coupled to a variable speed pulley 82. A belt from pulley 82 drives a gear reducer 83 which is coupled to a first sprocket 84. A forty-pitch chain 85 couples first sprocket 84 to a second sprocket 86. Sprocket 86 is coupled to rotate front shaft 24 which includes a plurality of sprockets (not shown) to drive anti-friction belts 20. At the right side of FIG. 3, a third sprocket 87 coupled to and driven by shaft 24 drives a fourth sprocket 88 via a belt 89 (FIG. 1). Sprocket 88 powers a brake 90 with a clutch 91 coupled thereto (FIG. 3). Clutch 91 drives a shaft 92 which is geared to drive paddle wheel 50. The gearing cooperates with limit switches so that 1.5 revolutions (in the illustrated embodiment, nine paddles 52 of paddle wheel 50) occur during each cycle of operation. A cycle can be initiated by manual operation, such as by foot pedal activation (hereinafter described), or an automatic mode of operation can be used so that the machine responds to the presence of another carton to be filled.

Also illustrated in the figures are an electrical box 93 for coupling electrical power to motor 26 and an adjustment device 94 for variable speed pulley 82.

A foot pedal 95 is shown at the bottom left portion of FIG. 1. The foot pedal when actuated commences a cycle of operation. In particular, once the foot pedal 95 is depressed, the paddle wheel 50 begins its cycle of 1.5 revolutions wherein nine sections (illustratively) are rotated. This releases sixty-three tomatoes through holding or counting station 14. Moreover, tomatoes will have been held in the escrow lane 35 by virtue of air cylinder 41*b* having had its arm extended to intercept tomatoes. Air Cylinder 41*a* will have had its arm retracted to allow the escrow lane 35 to be loaded, but upon actuation of foot pedal 95, air cylinder 41*a* extends its arm into the path of new tomatoes entering escrow lane 35. Air cylinder 41*a* will have been adjusted in its position along the slidable track so that a predetermined number of escrow tomatoes can fit between air cylinder 41*a* and air cylinder 41*b*, and such escrow tomatoes will then pass from escrow lane 35 into carton 66 during the time that paddle wheel 50 is revolving. Thus, a controlled, counted number of tomatoes is loaded into the carton.

Machine 10 can be adapted to load tomatoes by weight rather than by count. A sensing mechanism beneath carton 66 can signal air logic system 78 to rotate paddle wheel 50 until a preselected weight is developed quickly at carton 66. Then, as an option, escrow lane 35 can provide one, two, or another number of tomatoes to increase the weight of carton 66 at a slower rate until a prescribed weight, or weight range, is developed thereat.

Figure 10:
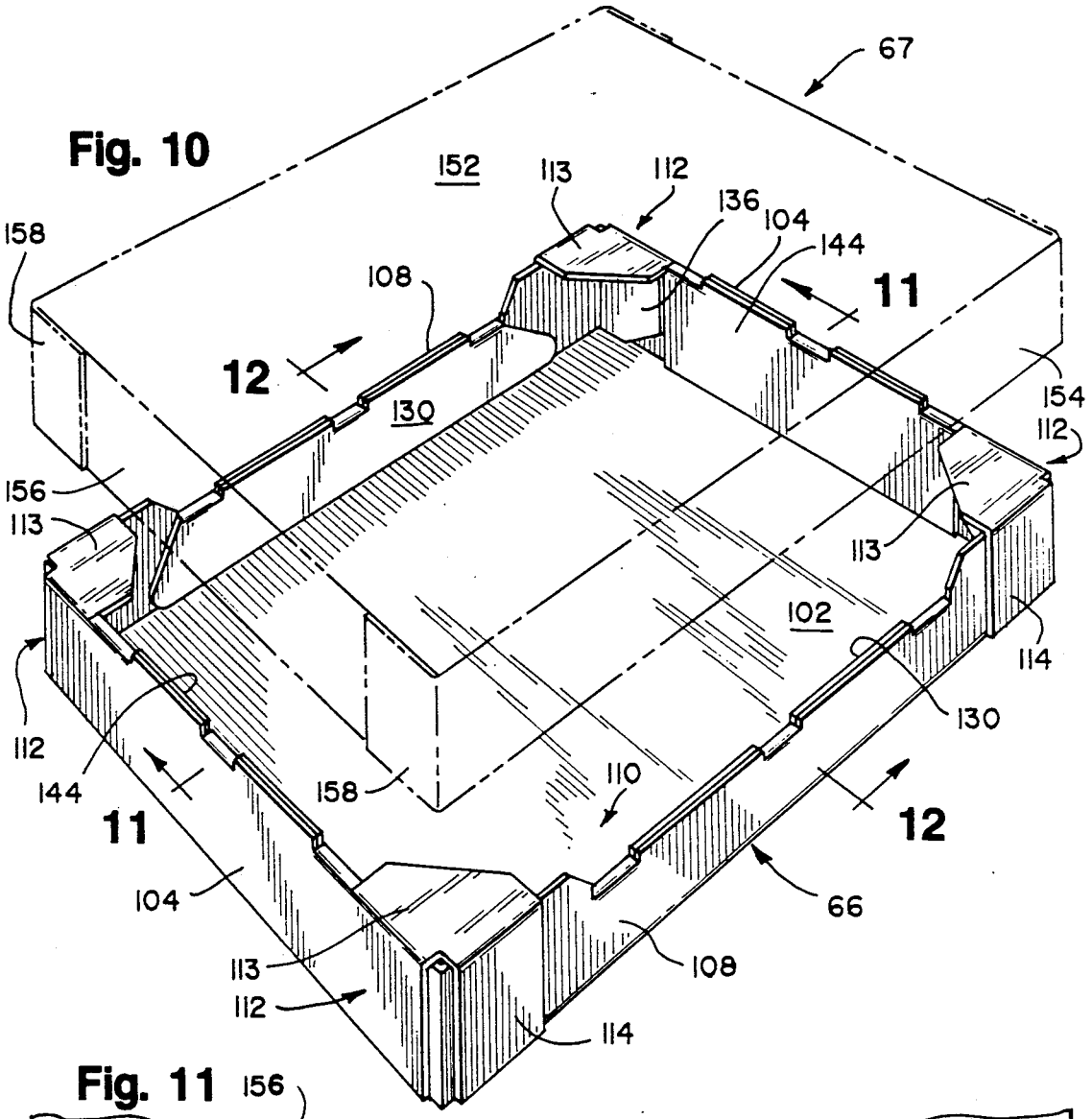
FIG. 10 is a perspective view of the carton in FIG. 6 with the lid exploded therefrom and shown in broken lines.

The preferred carton 66 is shown in its assembled form and with a lid 67 in FIGS. 6 and 7, and in its assembled form and with lid 67 in dotted lines in FIG. 10, and the carton and lid are shown as unassembled blanks in FIGS. 8 and 9, respectively, fold lines are indicated by broken lines and score lines are shown as solid lines. As seen generally in FIG. 7, carton 66 has a generally rectangular shape when viewed from above, and as seen generally in FIGS. 11 and 12, its side walls have a maximum height greater than the diameter of an average tomato. Illustratively, the height of carton 66 is about 4 inches, thereby allowing a layer of tomatoes T to fit in the carton and permitting an air space between the top surface of the tomatoes and the top of carton 66. Lid 67 also has a generally rectangular shape when viewed from above, and has dimensions to fit over carton 66 to form an enclosure area within carton 66 for the tomatoes T.

As illustrated in FIGS. 6 and 7, carton 66 includes a floor 102 which is generally rectangular in shape. Along the shorter sides of the floor 102, side walls 104 extend perpendicularly upwardly from floor 102. Perpendicular side walls 108 form the longer sides of carton 66 and each wall 108 includes a recess 110.

Corner portions 112 extend from the four top corners of carton 66 from side walls 104 and are folded at 90 degree angles with respect to vertical side walls 104 and 108 so that each corner portion forms a support member or element 113 for lid 67 and loads which may be placed over lid 67, which extends in a plane parallel to floor 102. Each corner portion 112 further includes a flap 114 which folds over the adjacent longer wall 108.

Figure 13:
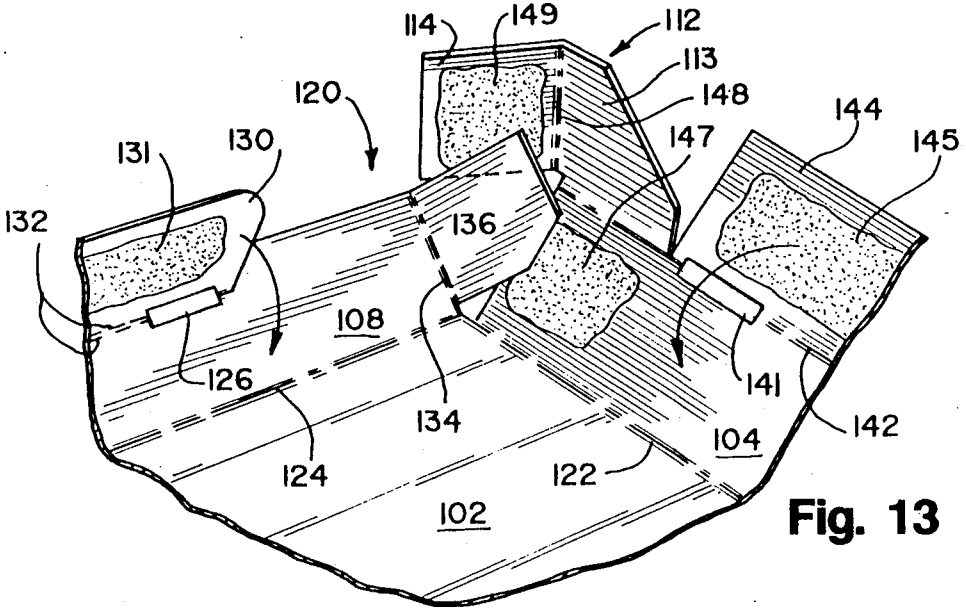
FIG. 13 is a fragmentary view of a corner portion of the carton in FIG. 6 illustrating assembly of the carton.

FIG. 8 illustrates an unassembled blank 120 for making carton 66. Preferably, blank 120 is made of corrugated fiberboard, although other materials could be used. Parallel fold lines 122 perpendicular to parallel fold lines 124 comprise inner fold lines which define rectangular floor 102. Six rectangular holes 126 can be punched adjacent to fold lines 132. Holes 126 can facilitate the folding of a long flap 130 onto side wall 108. Flap 130 is defined by two spaced parallel fold lines 132 and score lines 133. It will be understood that score lines are cut entirely through blank 120. Flap 130, as shown in FIG. 7, extends from side wall 108 so that when a 90 degree angle is made at fold line 124, side wall 108 becomes perpendicular to floor 102. A 180 degree angle is made at the two fold lines 132 and at score lines 133 so that flap 130 folds back on side wall 108. Six rectangular holes 126 can be punched adjacent to fold lines 132. Holes 126 can facilitate the folding of flap 130 onto side wall 108. This provides a double thickness of corrugated fiberboard along a long portion of side wall 108. Flap 130 is then secured to side wall 108. As shown in FIG. 13, at least one adhesive patch 131 is preferably used to join flap 130 to side wall 108. Especially preferable for securing flap 130 to side wall 108 is the concurrent use of two types of adhesive or glue: a cold bonding adhesive, such as a cold-set resin adhesive, is applied, such as by spraying on, and a hot melt adhesive can be selectively and concurrently placed along flap 130 to assist in holding flap 130 to side wall 108 while the cold resin adhesive sets. The cold-set resin adhesive is preferably applied along the entire length of flap 130 to provide additional structural strength.

Short fold lines 134 on wall 108 perpendicular to fold lines 124 define corner pieces 136. Corner pieces 136 become perpendicular to side wall 108 after a fold is made along fold line 134, and become vertically oriented.

Turning now to the shorter side walls 104, after a fold is made along line 122, wall 104 becomes perpendicular to floor 102. Fold lines 142 permit an outer flap 144 defined by score lines 146 and fold lines 142 to be folded onto wall 104 thereby providing a double thickness of corrugated fiberboard along short side wall 104. Six rectangular holes 141 can be punched along fold lines 142. Each of the edges of holes 141 are alternatively either substantially parallel to or substantially perpendicular to the corresponding fold line 142. Holes 141 are punched along fold lines 142 so that a fold line 142 intersects opposite edges of each hole 141, instead of intersecting an entire edge of each hole 141. As shown in FIG. 8, fold lines 142 are also substantially in line with the longitudinal center line of the corresponding holes 141. Holes 141 can facilitate the folding of flap 144 onto side wall 104. Outer flap 144 is secured to wall 104. As shown on FIG. 13, at least one adhesive patch 145 is preferably used to join flap 144 to wall 104, particularly with the two-glue arrangement discussed above.

Side walls 108 and 104 are secured together by securing corner piece 136 on walls 108 to side wall 104. As shown in FIG. 13, an adhesive patch 147 on side wall 104 is preferably used to join corner piece 136 to wall 104, particularly with the two-glue arrangement discussed above.

As shown in FIG. 8, each score line 146 also defines part of corner portion 112, which is coupled to flap 114. Flap 114 is folded along a fold line 148. When corner portion 112 is folded along fold line 142, it extends horizontally. When a fold is made along fold line 148, flap 114 extends vertically downward (after assembly) from corner portion 112 to be secured to the outside of (vertical) side wall 108. As shown in FIG. 13, at least one adhesive patch 149 is preferably used to join flap 114 to wall 108, particularly with the two-glue arrangement discussed above.

After tomatoes T have been loaded in carton 66, lid 67 may be placed over carton 66. FIG. 6 illustrates an assembled lid 67. FIG. 9 illustrates an unassembled blank 150 for making lid 67. Preferably, blank 150 is made of corrugated fiberboard, although other materials could be used. Lid 67 includes lid top 152 which is generally rectangular in shape.

Figure 14:
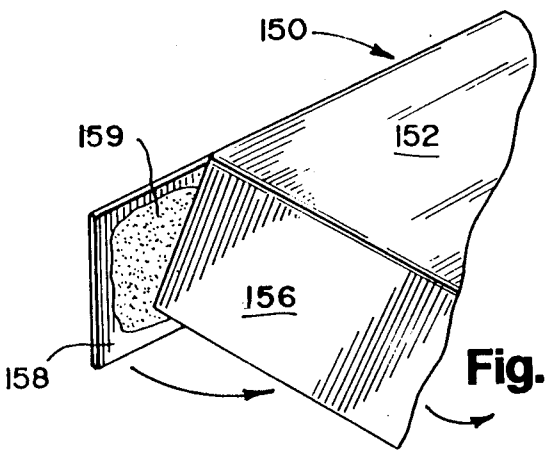
FIG. 14 is a fragmentary view of a corner portion of the cover in FIG. 6 illustrating assembly of the cover.

Parallel fold lines 160 perpendicular to parallel fold lines 162 comprise inner fold lines which define rectangular lid top 152. Side walls 154 are defined along the longer sides of lid top 152 by fold lines 160 and score lines 166. Side walls 154 are folded downward at 90 degree angles with respect to lid top 152. Similarly, side walls 156 along the shorter sides of lid top 152 are defined by fold lines 162 and score lines 166, and are folded downward at 90 degree angles with respect to lid top 152. At each end of side walls 154 is a flap 158 defined by fold lines 164. As illustrated in FIG. 14, after side walls 154 and 156 are folded downward at their 90 degree angles with respect to lid top 152, flaps 158 are folded (inward) at 90 degree angles to walls 154 and secured to the outer surface of side wall 156. At least one adhesive patch 159 is preferably used to join flap 158 to side wall 156, particularly with the two-glue arrangement discussed above.

Figure 11:
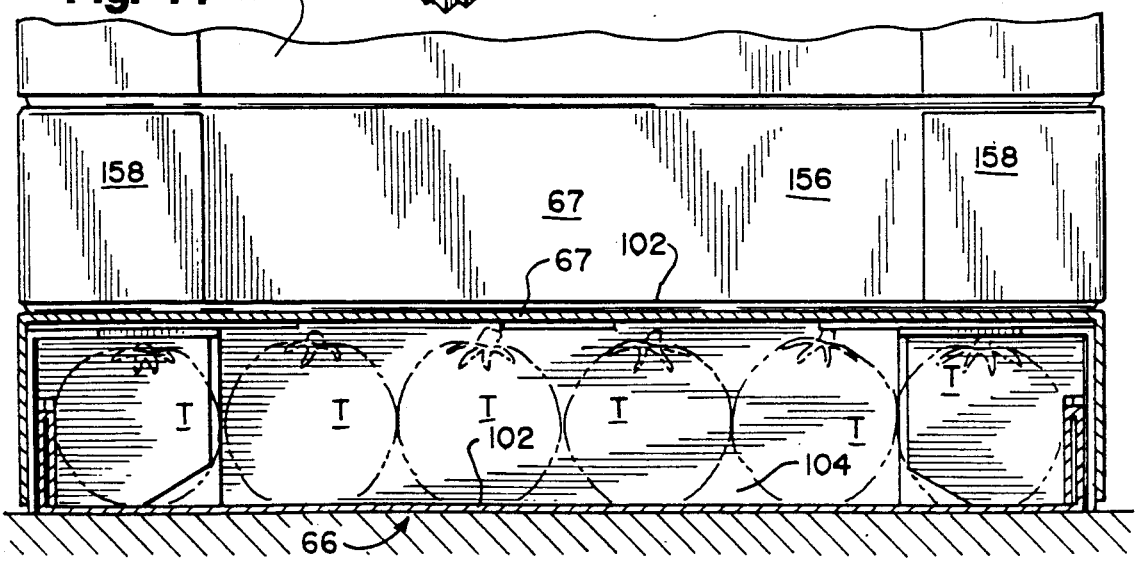
FIG. 11 is an end view of a vertical stack of several cartons in FIG. 10, with a sectional view of the bottom-most carton along the lines 11—11 in FIG. 10.
Figure 12:
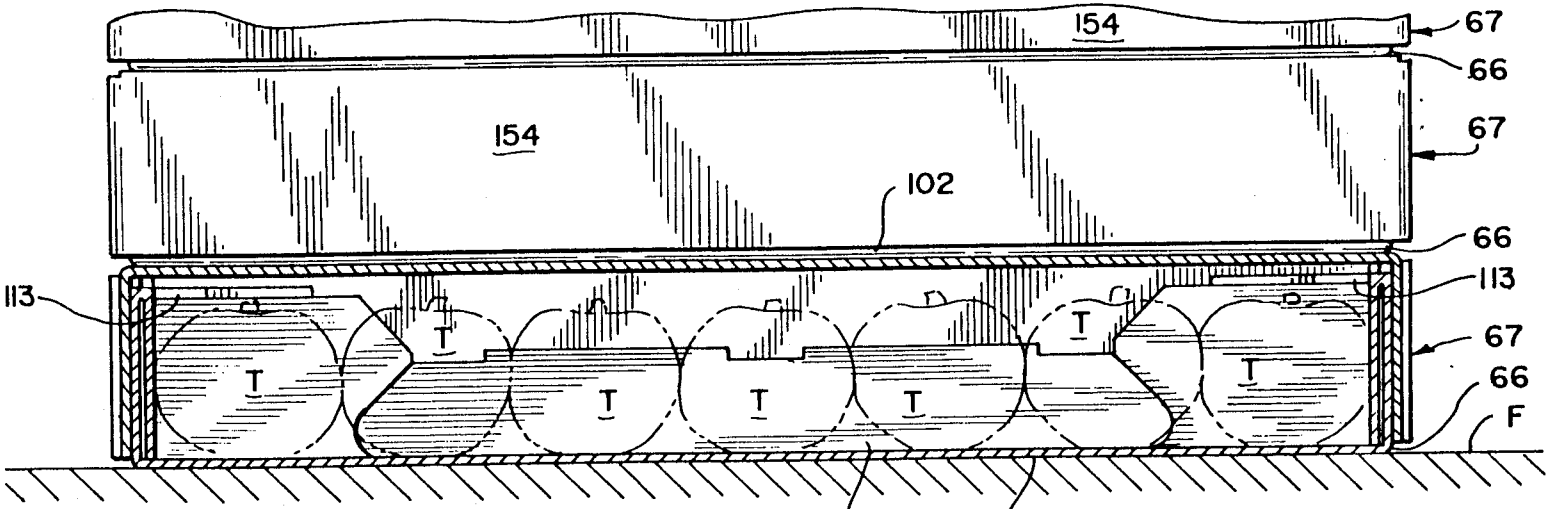
FIG. 12 is a side view of a vertical stack of several cartons in FIG. 10, with a sectional view of the bottom-most carton along the lines 12—12 in FIG. 10.

It will be appreciated that many cartons 66 each with a lid 67 thereon can be stacked vertically with tomatoes therein, as illustrated in FIGS. 11 and 12. Tomatoes T are illustrated in an upright position for illustration purposes only. Typically, in active practice, the tomatoes will be in a more random orientation, with many of the tomatoes on their sides. For example, fourteen to twenty-three or more cartons 66 can be directly stacked on top of each other without damaging the contents of carton 66. Consider upper and lower cartons. Floor 102 of the upper carton rests on top of lid 67. Lid 67 prevents the floor 102 from the carton above from falling into and crushing tomatoes in the lower carton. Additionally, the lower edges of side walls 104 and walls 108 of the upper carton rest on lid top 152 of lid 67. Additionally, support members 113 prevent the upper carton from falling into and crushing tomatoes in the lower carton.

A second embodiment of a carton 66', which has similarities to carton 66, can be used without a lid. Carton 66' is shown in its assembled form in FIG. 15, and the carton is shown as an unassembled blank 150' in FIG. 16, where fold lines are indicated by broken lines and score lines are shown as solid lines. As seen generally in FIG. 15, carton 66' has a generally rectangular shaped when viewed from above, and its side walls have a maximum height greater than the diameter of an average tomato. Illustratively, the height of carton 66' is about 4 inches, thereby allowing a layer of tomatoes to fit in the carton and permitting an air space between the top surface of the tomatoes and the top of carton 66'.

Figure 15:
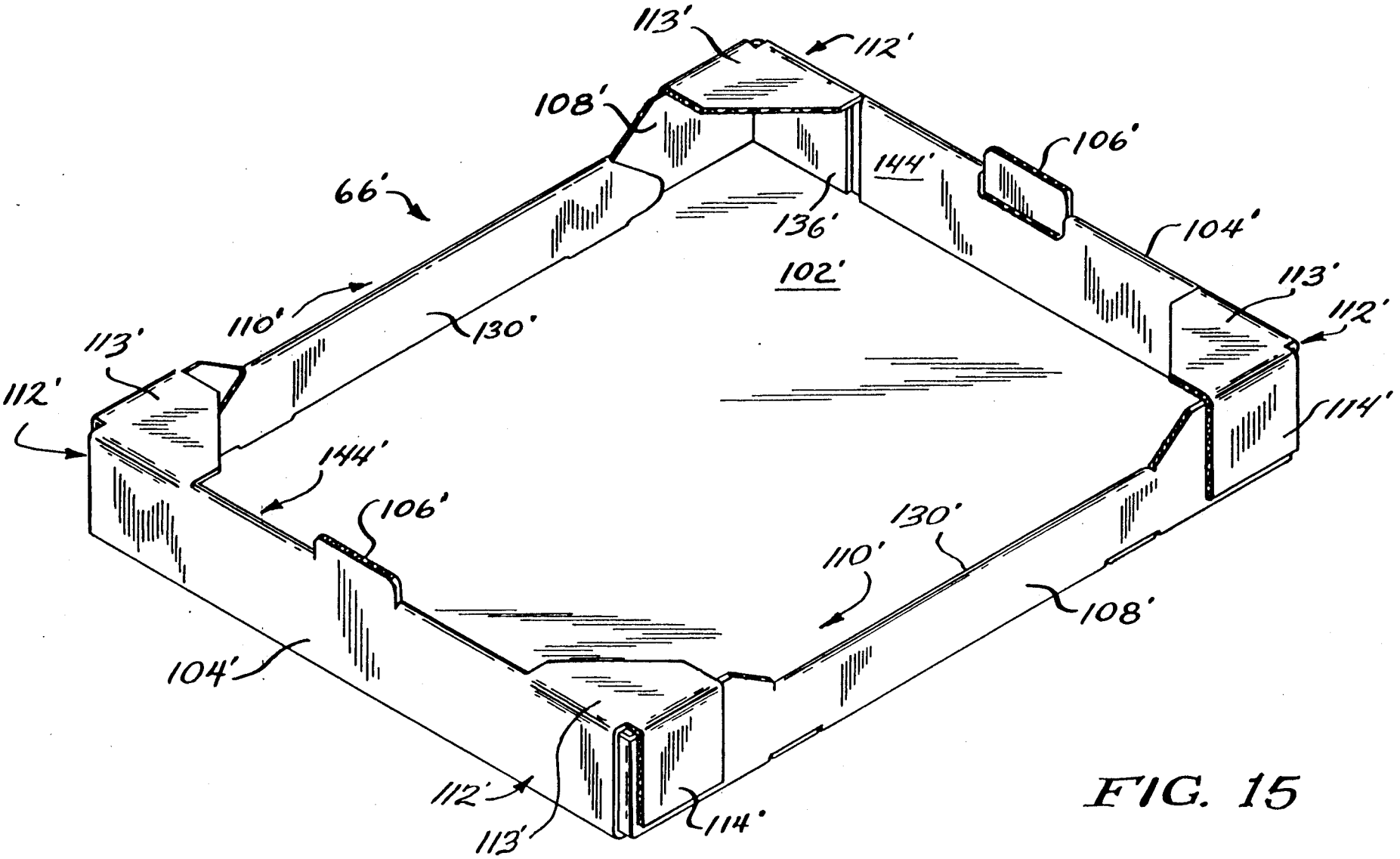
FIG. 15 is a perspective view of a second embodiment of a carton according to the present invention.
Figure 16:
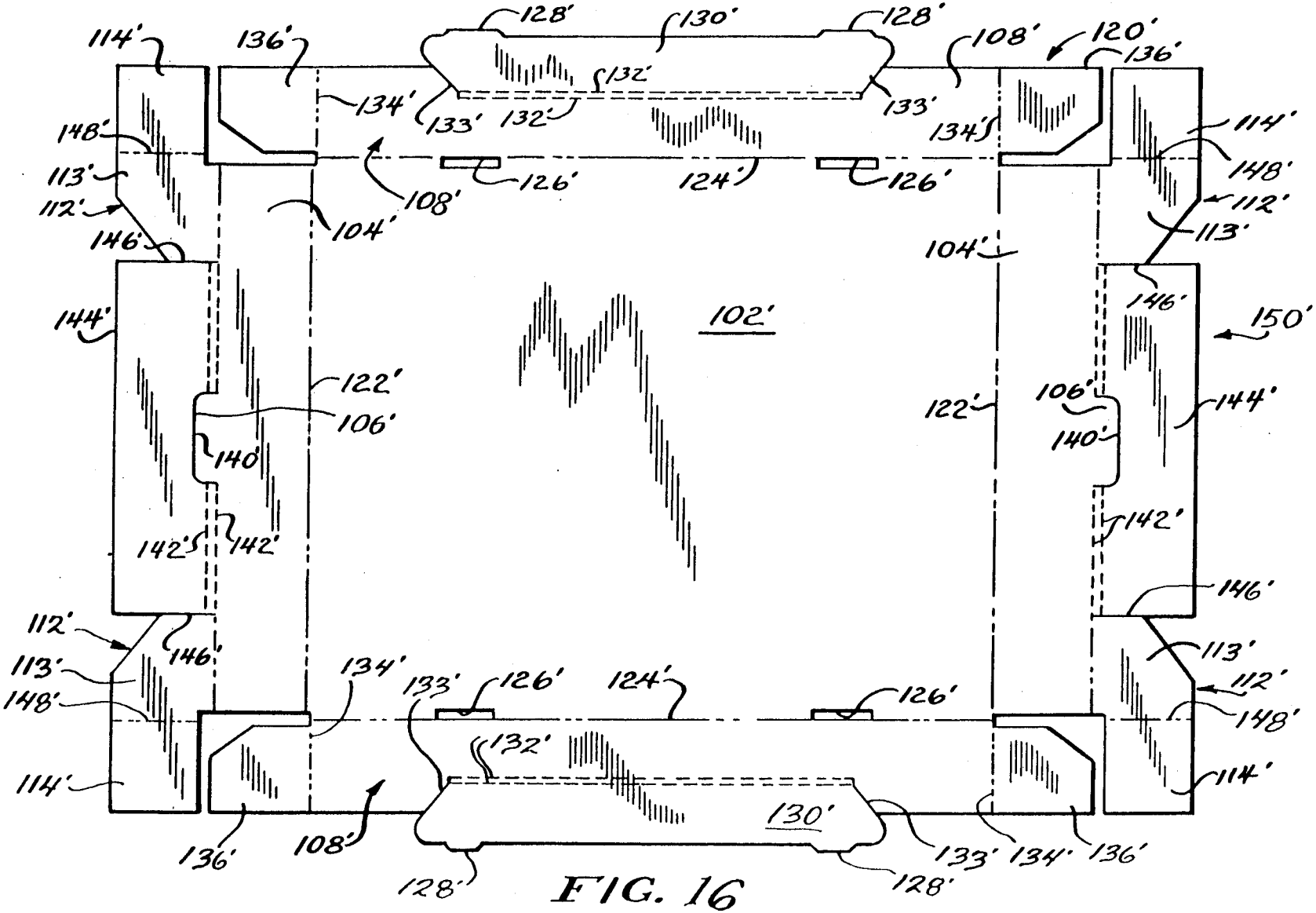
FIG. 16 is a plan view of an unassembled blank of the carton in FIG. 15.

As illustrated in FIGS. 15 and 16, carton 66, includes a floor 102' which is generally rectangular in shape. Along the shorter sides of floor 102', side walls 104' extend perpendicularly upwardly from floor 102'. Each side wall 104' includes a tab 106' extending upward from the main portion of side wall 104'. Perpendicular side walls 108' form the longer sides of carton 66' and each wall 108' includes a recess 110'.

Corner portions 112' extend from the four top corners of carton 66' from side walls 104' and are folded at 90 degree angles with respect to vertical side walls 104' and 108' so that each corner portion forms a support member or element 113' for loads which may be placed thereon, which extends in a plane parallel to floor 102'. Each corner portion 112' further includes a flap 114' which fold over the adjacent longer wall 108'.

FIG. 16 illustrates an unassembled blank 120' for making carton 66' and FIG. 15 illustrates an assembled carton 66'. Preferably, blank 120' is made of corrugated fiberboard, although other materials can be used. Parallel fold lines 122' perpendicular to parallel line 124' comprise inner fold lines which define rectangular floor 102'. Four rectangular holes 126' can be punched adjacent to fold lines 124'. Holes 126' can facilitate the folding of a long flap 130' onto side wall 108'. Holes 126' are used to engage outer tabs 128' on long flap 130', long flap 130' being defined by two closely spaced parallel fold lines 132' and score lines 133'. It will be understood that score lines are cut entirely through blank 120'. Flap 130' extends from side wall 108' so that when a 90 degree angle is made at fold line 124', side wall 108' becomes perpendicular to floor 102'. A 180 degree angle is made at the two fold lines 132' so that flap 130' folds back on side wall 108' to let tabs 128' engage holes 126'. This provides a double thickness of corrugated fiberboard along a large portion of side wall 108'. Flap 130' is secured to side wall 108', preferably with the two-glue arrangement discussed above.

Short fold lines 134' on side wall 108' and perpendicular to fold lines 124' define the corner pieces 136'. Corner pieces 136' become perpendicular to side wall 108' after a fold is made along fold line 134', and become vertically oriented.

Turning now to the shorter walls 104', after a fold is made along line 122', wall 104' becomes perpendicular to floor 102'. A score line 140' defines tabs 106', and fold lines 142' permit an upper flap 144' defined by score lines 146' and fold lines 142' to be folded onto wall 104' thereby providing a double thickness of corrugated fiberboard along the short side wall 104'. Flap 144' is secured to side wall 104', preferably with the two-glue arrangement discussed above.

Side walls 108' and 104' are secured together by securing corner pieces 136' on walls 108' to side walls 104', preferably with the two-glue arrangement discussed above.

Each score line 146' also defines part of corner portion 112', which is coupled to flap 114'. Flap 114' is folded along a fold line 148'. When corner portion 112' is folded along fold line 142', it extends horizontally. When a fold is made along fold line 148', flap 114' extends vertically downward (after assembly) from corner portion 112' to be secured to the outside of (vertical) side wall 108', preferably by the two-glue arrangement discussed above.

It will be appreciated that many cartons 66' can be stacked vertically with tomatoes T therein. For example, fourteen to twenty-three or more cartons 66' can be directly stacked on top of each other without damaging o the contents of carton 66'. Consider upper and lower cartons stacked on floor F. Floor 102' of the upper carton rests on top corner portions 112' of the lower carton. Specifically, support members 113' prevent the floor 102' from the carton above from falling into and crushing tomatoes in the lower carton. Further, side walls 104' of the upper carton are engaged by the upstanding tabs 106' of the lower carton. The tabs 106' serve to hold the upper and lower cartons in place. Tabs 106' are pushed slightly outward when an upper carton 66' is stacked onto the lower carton 66'. Because of the large recesses 110', there will be air flow over the tomatoes in each carton 66', notwithstanding that another carton may be stacked on top of it.

While simple in construction, carton 66 provides a very economic use of corrugated fiberboard as it can be seen that there is very little waste. Moreover, even though only a single wall corrugation is used in the preferred embodiment, carton 66 exhibits enough strength to support 21 pounds or more of tomatoes. Double thickness corrugation can be used, and other variations in construction can be made. By packing the tomatoes in a single layer in carton 66, spoilage is reduced in three ways. First, there is no pressure on any tomato from a tomato above it. Second, if one tomato spoils, there are no tomatoes beneath it which will be contaminated by the spoilage. Also, there is no spoilage due to concussion bruising. But, if any spoilage occurs naturally of a single fruit, the corrugated fiberboard carton absorbs moisture, decay, and spoilage directly below the tomato or fruit.

Another advantage of carton 66 is that it is preferably dimensioned so that four such cartons can be arrayed in a two-by-two contiguous arrangement which matches the size of a standard 48 by 40-inch pallet. This promotes stacking numerous cartons 66 in two-by-two arrangements, four cartons to a layer, on a single shipping pallet which can then be transported easily.

Carton 66 is also useful in a system and method of artificial ripening of tomatoes. As discussed above, it is frequently desirable to artificially ripen the tomatoes at least to some degree at some point between harvesting, but before being shipped to the store or restaurant. A current method of artificially ripening tomatoes involves exposing the tomatoes to a gas containing ethylene. The tomatoes are typically placed into a substantially gas-sealed room with the ethylene being pumped into the room at a predetermined concentration, humidity and temperature. The ethylene can either itself be introduced into the room or introduced as part of a gaseous mixture. The ethylene is introduced in a concentration sufficient to effectuate the ripening of the tomatoes. The ethylene is allowed to remain in the room for a predetermined amount of time sufficient to effectuate the desired degree of ripening of the tomatoes, and then the tomatoes are removed. Additional ethylene may have to be pumped in during this predetermined amount of time to maintain a constant level of ethylene concentration. During the time that the ethylene is in the room, ripening of the tomatoes is artificially accelerated. The amount of time that the tomatoes remain exposed to the ethylene depends generally on the ripeness or maturity of the tomatoes when first placed in the room and on the degree of final ripeness to be achieved. Accordingly, the carton is of sufficient strength to withstand exposure to ethylene gas, humidity and temperature for this period of time.

Tomatoes are not the only produce which may be artificially ripened. Numerous kinds of fruits and vegetables may be artificially ripened. It must be noted that this known artificial ripening method comprising ethylene works especially well for fruits and vegetables which themselves give off ethylene during natural ripening. In general, the additional ethylene serves to reduce the time of ripening over natural ripening.

The system and method of artificial ripening of the present invention comprises packing a single layer of tomatoes into a carton 66 before placement of the tomatoes into the gas-sealed room. Currently, tomatoes are placed directly into the sealed room in the 25 pound bulk pack boxes in which they were placed after harvesting. The packing of the tomatoes into the single layer packed cartons 66 and placement of the single layer packed cartons 66 into the sealed room has been experimentally determined to yield the following advantages. First, the amount of time typically necessary to leave the tomatoes in a sealed room is reduced. Although the amount of time that the tomatoes are left in the room depends on ripeness (or maturity) of tomatoes when first placed in the room and on the degree of ripening desired, the tomatoes are typically left in the sealed room to ripen for seven to nine days. Under the current method, this time for artificial ripening is typically reduced to three to five days.

Second, an increased uniform ripening of all of the tomatoes in the room is achieved as a result of packing the tomatoes in a single layer in cartons 66 before placement into the gas-sealed room. The more uniform ripening of the tomatoes results in a reduction of up to 60% of processing time after artificial ripening and sorting.

Specifically, the tomatoes in the bulk pack boxes have a certain range of ripeness when initially placed in the sealed room. Simply, some tomatoes are riper than others. Under the current methods of ripening, each tomato ripens a certain amount, with tomatoes leaving the sealed room still in different states of ripeness. The tomatoes must, therefore, be color sorted to place all of the tomatoes together with other tomatoes of the same degree of ripeness.

Under the method and system of the present invention, by packing the tomatoes in single layers into cartons 66, ripening of the tomatoes occurs more uniformly. In other words, tomatoes may start off being at different degrees of ripeness, but when removed from the room, the tomatoes may be of substantially the same ripeness. It has been experimentally determined that tomatoes which enter the room that are relatively unripe go through more of a degree of ripening than tomatoes that are relatively more ripe when they enter the room. The tomatoes exiting the room are typically not noticeably different in ripeness. Consequently, the tomatoes do not have to be color sorted, resulting in the reduced processing time.

Although not wanting to be bound to a theory as to why the packaging of the tomatoes in single layer cartons 66 results in the above-identified advantages, it is believed that the packaging of the tomatoes in single layers allows the tomatoes to be more efficiently exposed to either the introduced ethylene and to the ethylene naturally given off by the tomatoes themselves or by other tomatoes within the same or neighboring cartons. The single layer packaging of the tomatoes, rather than a random bulk arrangement in a bulk pack box, results in these advantages. The random bulk arrangement does not allow the same effective exposure to the ethylene as the single layer packaging. In the random arrangement, the ethylene must travel inwardly in the bulk to reach the inner tomatoes in the bulk.

An alternative embodiment of the system and method comprises utilizing the ethylene naturally given off by the tomatoes to further accelerate the ripening of the tomatoes. Specifically, some of the ethylene naturally given off by the tomatoes is confined within carton 66. In this way, the concentration of ethylene around the tomatoes is increased not by the introduction of additional ethylene, but by confining at least enough of the ethylene and natural ethylene produced within the box to sufficiently increase the ethylene concentration to enhance ripening of the tomatoes. As an initial step, the tomatoes are packed in carton 66 in a single layer. Lid 67, for example, is placed over carton 66 to enclose carton 66. Lid 67 assists in confining some of the ethylene given off within cartons 66. As discussed above, a number of cartons 66 can be stacked vertically and next to each other. It has been experimentally determined that the same advantages discussed above are also substantially accrued by this embodiment. The stack or stacks of cartons 66 can further be wrapped in plastic to additionally confine some of the ethylene naturally given off and temperature within cartons 66. The plastic wrap therefore aids in confining some of the ethylene within the carton 66. Further, the wrapping of the stack or stacks helps support the stack or stacks during shipping.

It will be appreciated that the embodiments described herein are capable of various modifications and alterations within the scope and spirit of the present invention. Accordingly, this specification and drawings are intended in an illustrative and non-limiting sense.

What is claimed is:

1. A carton suitable for containing produce formed from a single carton blank, comprising:

first and second inner fold lines defining a pair of parallel inner fold lines (122) and third and fourth inner fold lines defining a second pair of parallel inner fold lines (124), said second pair of inner fold lines (124) being perpendicular to said first pair of inner fold lines (122) wherein the intersection of said inner fold lines (122, 124) defines a rectangular floor and a bottom for each of a first and second end wall (104) and a first and second sidewall (108), said end walls (104) extending upwardly from said first and second inner fold lines respectively said sidewalls (108) extending upwardly from said third and fourth inner fold lines respectively;

first and second outer fold lines defining a first pair of outer fold lines (142), said first outer fold line located at a first distance from said first inner fold line and defining a top of said first end wall wherein said first outer fold line defines at least a portion of a first flap, said first flap being folded over said first outer fold line thereby extending downwardly from said first outer fold line, said second outer fold line located at a second distance from said second inner fold line defining a top of said second end wall wherein said second outer fold line defines at least a portion of a second flap, said second flap being folded over said second outer fold line thereby extending downwardly from said second outer fold line;

at least one rectangular hole having four side edges (141) along each said first and second outer fold lines facilitating the folding of each said first and second flaps respectively, said first outer fold line intersecting said rectangular hole which is along said first outer fold line only at a single point on opposite edges of said rectangular hole and said second outer fold line intersecting said rectangular hole which is along said second outer fold line only at a single point on opposite edges of said rectangular hole; and third and fourth outer fold lines defining a second pair of outer fold lines (132), said third outer fold line located at a first distance from said third inner fold line and defining a top of said first sidewall wherein said third outer fold line defines at least a portion of a first sidewall flap, said first sidewall flap being folded over said third outer fold line thereby extending downwardly from said third outer fold line, said fourth outer fold line located at a second distance from said fourth inner fold line defining a top of said second sidewall wherein said fourth outer fold line defines at least a portion of a second sidewall flap, said second sidewall flap being folded over said fourth outer fold line thereby extending downwardly from said fourth outer fold line whereby said carton is formed.

2. The carton according to claim 1 wherein two edges of said rectangular hole which is along said first outer fold line are substantially parallel to said first outer fold line and wherein two edges of said rectangular hole which is along said second outer fold line are substantially parallel to said second outer fold line.

3. The carton according to claim 1 wherein a longitudinal center line of each said rectangular hole along said first outer fold line and along said second outer fold line respectively is substantially in line with said first and second outer fold lines, respectively.

4. The carton according to claim 1 wherein said first distance of said first outer fold line is substantially one-half the distance between said first inner fold line and an outer edge of said first flap and wherein said second distance of said second outer fold line is substantially one-half the distance between said second inner fold line and an outer edge of said second flap.

5. The carton according to claim 1 wherein said first and second flaps are secured to an adjacent portion of said first and second end walls respectively with a cold bonding adhesive and a hot melt adhesive after said first and second flaps are folded over said first and second outer fold lines, respectively.

6. The carton according to claim 5 wherein said first and second sidewall flaps are secured to an adjacent portion of said first and second sidewalls respectively with a cold bonding adhesive and a hot melt adhesive after said first and second sidewalls flaps are folded over said third and fourth outer fold lines, respectively.

7. A carton suitable for containing produce formed from a single carton blank, comprising:

a generally rectangular floor;

first walls and second walls extending from said floor; and, one of said walls including a fold line defining at least a portion of a flap, said flap being folded over said fold line to form a double thickness sidewall portion;

said flap secured to an adjacent portion of said wall with a cold bonding adhesive and a hot melt adhesive after said flap is folded over said fold line.

8. The carton according to claim 7 wherein said cold bonding adhesive is applied along the entire length of said flap to provide additional structural strength.

9. The carton according to claim 7 wherein said cold-bonding adhesive is a cold-set resin adhesive.

* * * * *

UNITED STATES PATENT AND TRADEMARK OFFICE

CERTIFICATE OF CORRECTION

PATENT NO. : 5,052,615

DATED : October 1, 1991

INVENTOR(S) : Edward L. Ott, Paul F. Petriekis, Michael E. Janis

It is certified that error appears in the above-identified patent and that said Letters Patent is hereby corrected as shown below:

Col. 3, line 5, delete "on" and insert therefor --one--.

Col. 5, line 40, before "provided" insert --also--.

Col. 7, line 6, after "section" insert a semi-colon --;--; and line 63, delete "infra" and insert therefor --infra--.

Col. 14, line 11, delete "66" and insert therefor --66'--.

Col. 15, line 12, before "the" delete "o".

Col. 18, line 64, delete "sidewalls" and insert therefor --sidewall--.

Signed and Sealed this

Sixteenth Day of March, 1993

*Attest:*

STEPHEN G. KUNIN

*Attesting Officer*

*Acting Commissioner of Patents and Trademarks*